US009051099B2

(12) United States Patent
Salinas

(10) Patent No.: US 9,051,099 B2
(45) Date of Patent: Jun. 9, 2015

(54) ONE PIECE DISPENSING LID

(71) Applicant: Jose Rodrigo Oliva Salinas, Colonia Jardines de la Montana CP (MX)

(72) Inventor: Jose Rodrigo Oliva Salinas, Colonia Jardines de la Montana CP (MX)

( * ) Notice: Subject to any disclaimer, the term of this patent is extended or adjusted under 35 U.S.C. 154(b) by 207 days.

(21) Appl. No.: 13/713,492

(22) Filed: Dec. 13, 2012

(65) Prior Publication Data

US 2014/0166157 A1 Jun. 19, 2014

(51) Int. Cl.
*B65D 51/28* (2006.01)

(52) U.S. Cl.
CPC ..... *B65D 51/2835* (2013.01)

(58) Field of Classification Search
CPC ..... B65D 51/2835
USPC ..... 141/112, 114, 329, 330; 206/219; 222/83, 91, 145.1, 206, 541.2
See application file for complete search history.

(56) References Cited

U.S. PATENT DOCUMENTS

| | | | | |
|---|---|---|---|---|
| 3,995,773 | A * | 12/1976 | Schmit | 222/91 |
| 5,141,133 | A * | 8/1992 | Ninomiya et al. | 222/83 |
| 5,228,592 | A * | 7/1993 | Pellerano | 222/83 |
| 5,297,696 | A * | 3/1994 | Bernstein et al. | 222/83 |
| 5,927,549 | A * | 7/1999 | Wood | 222/83 |
| 6,152,296 | A * | 11/2000 | Shih | 206/222 |
| 6,921,087 | B2 * | 7/2005 | Takahashi et al. | 277/628 |
| 6,926,138 | B1 * | 8/2005 | Basham et al. | 206/222 |
| 7,458,486 | B2 * | 12/2008 | Weist et al. | 222/83 |
| 7,540,405 | B2 * | 6/2009 | Sase et al. | 229/125.14 |
| 7,562,782 | B2 * | 7/2009 | Yorita | 215/228 |
| 7,568,576 | B2 * | 8/2009 | Sweeney et al. | 206/219 |
| 8,556,103 | B2 * | 10/2013 | Tiesberger | 220/254.8 |
| 8,672,185 | B2 * | 3/2014 | Worthington et al. | 222/132 |
| 2004/0026422 | A1 * | 2/2004 | Westphal | 220/277 |
| 2004/0099686 | A1 * | 5/2004 | Rho | 222/83 |
| 2005/0236424 | A1 * | 10/2005 | Walters et al. | 222/83 |
| 2006/0006192 | A1 * | 1/2006 | Smith et al. | 222/83 |
| 2007/0102394 | A1 * | 5/2007 | Olsen et al. | 215/311 |
| 2010/0044254 | A1 * | 2/2010 | Romeo | 206/221 |
| 2010/0237075 | A1 * | 9/2010 | Wilhelm | 220/284 |
| 2011/0108442 | A1 * | 5/2011 | Cho | 206/219 |
| 2011/0147414 | A1 * | 6/2011 | Chen | 222/83 |
| 2011/0259769 | A1 * | 10/2011 | Salinas | 206/219 |
| 2011/0290677 | A1 * | 12/2011 | Simonian et al. | 206/219 |
| 2011/0290678 | A1 * | 12/2011 | Simonian et al. | 206/219 |
| 2012/0217178 | A1 * | 8/2012 | Rohr et al. | 206/219 |
| 2013/0043149 | A1 * | 2/2013 | Zheng | 206/219 |
| 2013/0134055 | A1 * | 5/2013 | Wu | 206/219 |
| 2013/0140198 | A1 * | 6/2013 | Rohr et al. | 206/219 |
| 2013/0146598 | A1 * | 6/2013 | Salinas | 220/269 |
| 2014/0166157 | A1 * | 6/2014 | Salinas | 141/329 |

FOREIGN PATENT DOCUMENTS

WO WO 2006123946 A1 * 11/2006

* cited by examiner

*Primary Examiner* — Timothy L Maust
*Assistant Examiner* — Andrew Schmid
(74) *Attorney, Agent, or Firm* — Welsh Flaxman & Gitler LLC

(57) ABSTRACT

One-piece dispensing closure or lid molded in a single mold not requiring assembly of independent pieces, except for a seal after filling the closure with the additive. The closure has a round side skirt and security or tamper evident band, provided inside with threaded ribs, a flexible diaphragm with a tearing structure made up of a central stem and a tearing cylinder having a plurality of tearing tips to break the seal and release the additive.

8 Claims, 5 Drawing Sheets

ONE PIECE DISPENSING LID

FIELD OF THE INVENTION

The present invention relates to a one piece dispensing closure or lid, particularly to a plastic cap close molded for release of concentrate within a beverage container to add flavor that can be a flavoring, a vitamin, a medicine or other product.

BACKGROUND OF THE INVENTION

The application field is in the market of flavored beverages, energy beverages, food supplements, vitamin supplements, natural supplements, medicine supplements, chemical supplements or others, that once mixed with the liquid the shelf life of the product is substantially reduced. As such, once mixed they must be consumed or used in a short term.

The product or concentrate to be mixed can be powder, pellets or liquid retained in the cavity or seal of the cap. The cap or lid is used to hermetically close: the bottles or containers that were previously filled with the liquid in the filling lines; the bottle with its cap ready to be delivered to the market; a bottle labeling operation; and/or a secondary packing that may still be pending.

It is possible to fill the caps beforehand in a parallel caps filling line, in the bottling plant, and feed these caps with the concentrate to the bottling lines. It is also possible to fill them in a separate plant and deliver them to the bottling plant for attachment thereof in the line during bottling.

Once filled with the product, the caps are placed in the mouth of the bottles by means of a closing machine, which is part of the bottling line once the bottles have been filled with water or another liquid during the bottling process, the finished product is ready to be delivered to the market.

Once the finished bottle is in the hands of the end user, he/she will activate the mechanism to release the product, which will mix with the liquid. The end user will then shake the bottle. Once the product and liquid are mixed, the bottle is opened by twisting the cap to break the seal band (that may not be in the body of the cap). In this way the mixture of the liquid with the product is ready for consumption.

In the state of the art, there are caps or lids having some drawbacks in relation with the cap of the present invention, as is case of a "Lacto Tab™" cap, which is a cap used in the "Lacto Tab™" product of EMMI, from Switzerland. The "Lacto Tab™" cap comprises five plastic parts and a bottle with a special neck. The cap comprises a capsule formed with two aluminum sheets. In this capsule is contained the powder or liquid product, be it a flavoring, vitamin or energy supplement. This capsule is attached on the neck of the bottle and it adheres by means of an induction process, next the special shape and form cap, matching the neck of the bottle.

The cap is operated in the following manner. The cap is twisted clockwise, which breaks the seal or security band. By further twisting, an inner stem moves downwards, the stem on its lower end having teeth or spikes that twist with downwards movements. The aluminum cap is torn, allowing pouring of the product into the liquid contained in the bottle. Agitation of the package mixes the product with the liquid, thus making the mixture of the product with the liquid, and the resultant beverage ready for drinking. The cap in its top has a protection cover, which is withdrawn and the seal is pulled allowing exit of the liquid already mixed. This concept is used in caps of the type known as "sport," "sport cap", or "push-pull", as pushing the seal downwards again closes the exit duct of the product again.

In this product, this cap was used rarely and eventually went off the market since it was unsuccessful. Its cost was very high, and it consisted of five parts. In addition, the aluminum capsule must be pre-filled with the product, the cap requires assembly and a special neck in the bottle is required. In addition, it requires a special capping device or capping machine to set the aluminum capsule and then the cap, all this increases the cost of the product.

Another cap in the state of the art is the one-piece dispensing lid. The one-piece dispensing lid comprises a cylindrical section for storage of the product, which is sealed with an aluminum foil. The aluminum foil closes the storage section of the product. The cap has a semicircular section in the inner part, whose diameter bears in the wall of the storage section. In the center it has a stem that in the lower end has a series of spikes, this part being within the storage section.

The cap works in the following way. The concentrate product as a powder or a liquid is placed in the storage section, sealed with the aluminum foil, ready to be set. In the filling line, the caps are attached to the bottles with a standard neck of the market.

Once the bottle is in the hands of the consumer, he/she pushes downwards the semicircular part that is located at the center of the cap in the top part of the bottle. With this action, a stem is driven downwards. With the spikes located on its lower end, the stem breaks the aluminum seal, and allows the passage of the product towards the liquid with which it is mixed by the consumer agitating the bottle. Once the product has been mixed with the liquid, the cap is removed, just like the standard caps are removed, breaking the seal band and the product being ready for consumption.

Sometimes the rupture or tearing of the aluminum part is not enough to allow the complete exit of the product, resulting in a poor mixture, since the stroke of the stem is limited by the semi-circle. The cost of the injection molding is very high, since the form of the spikes in the stem is complex requiring molds of plastic injection with complex mechanisms that makes too expensive the cost of the piece. Also, sometimes the semicircular sector where the pressure was applied to break the aluminum returns to its original position, without sufficient tearing of the aluminum seal. This results in a poor mixture of liquid with product. It is efficient only for liquids, with problems when the concentrate is a powder or pellets.

US2011/0108442 published May 12, 2011, inventor Young-Kook Cho describes a beverage container cap dispensing a flavoring material contained in the bottle, comprising at least two parts. The cap body defines a hollow compartment filled with a flavoring concentrate and a central insert separating such compartments from the inside of the bottle. The insert is released by thread twisting opposite the body of the cap up to a stop in which the concentrate release is ensured.

US2011/0089059 published Apr. 21, 2011, inventor Lane Marvin et al, describes a flip top cap for the release of a concentrate with a central release hole. The cap comprises a round body with a plurality of additive containing compartments, which is released by pressing with a finger downwards to break the seal and release it to the inside of the container for mixing by means of agitation.

US2010/0044254, published on Feb. 25, 2010, inventor Joseph Romeo, describes a cap or closure adapted to release a flavoring concentrate within the container to mix with the contents thereof. The cap is provided with several sections, the top one containing the concentrate to be released through a valve activated by twisting the central part.

US2010/0012532 published Jan. 21, 2010, inventor Frutin Bernard, describes a cap for a container with means to introduce an additive within the contents of the container. The cap has a round body coupled to an external thread on the neck of the container, a flip top and a central compartment having a concentrate for release therethrough. The cap has a central stem with the lower end adapted as a valve to release the concentrate, which is made by pressing the stem downwards to disconnect the retaining valve.

US2009/0236303 published on Sep. 24, 2009, inventor Lizerbram Eric et al, describes a threadable cap adapted to release a concentrate or additive in the inside of the container. The cap has four pieces, a base with the compartment for the additive, a central stem, a beak for sucking and an anti-tamper seal. In addition, the cap has a membrane acting as a barrier to retain the additive which is torn by the stem.

Korean patent application KR20090014699, published on Feb. 11, 2009, inventor Young-Kook Cho, describes an additive cap provided with a cylindrical skirt with an internal thread for coupling with the external thread of the bottle, and an internal cylindrical body having two side holes allowing the addition of the additive to the liquid inside the container. The internal cylindrical body is acted upwards to free the dispensing holes or windows.

Korean patent application KR20070060132 corresponding to (U.S. Pat. No. 7,562,782), published on Jun. 12, 2007, inventor Yorita Katsuhiko, describes a container cap allowing the release of an additive within the container, provided with a lower deposit sealed by a stem with a seal tab. The stem is acted upwards to allow release of the additive.

US2007/0102394 published on May 10, 2007, inventor Olsen Geir L. et al, describes a bottle closure, provided with an additive containing cavity for release within the container. The release is made by acting on a central stem breaking the seal at the base of the closure and allowing the pouring of the additive for mixing with the contents of the container.

WO2006123946, published Nov. 23, 2006, inventor Sharp Jeffrey John, describes a cap or closure provided with a central flexible diaphragm holding a cylindrical structure in which a lower border having beaks which by pressure on the diaphragm breaks the seal place on the base of the cap with a hollow cylindrical body in which the additive for release is held.

Mexican patent application MXPA06002700 (corresponding to U.S. Pat. No. 7,475,774), published Sep. 4, 2006, inventor Clarkson Aron Joseph, describes a threadable cap provided with a cylindrical central compartment sealed by a metallic film that together with the cylindrical wall defines a compartment having an additive containing compartment for release within the container. The film is torn by knives or spikes located in the lower end of the central compartment by twisting the body of the cap, which raises such knives to tear the seal and release the additive.

U.S. Pat. No. 6,926,138, published Aug. 9, 2005, inventor Basham Mark Floyd et al, describes a cap for additive release into the contents of a container. The cap includes a threadable cylindrical body and a hollow central stem holding the additive to be released, having in its lower end a release preventing membrane. Driving the stem breaks the membrane and allows pouring the additive within the container.

U.S. Pat. No. 6,170,654, published Jan. 9, 2001, inventor Gartner Bradley Francis et al, describes a cap provided with a blister containing an additive released simultaneously with the opening of the container.

U.S. Pat. No. 6,152,296, published Nov. 28, 2000, inventor Shih Kuang-Sheng, describes a cap provided with an additive holder. The cap is suitable for polyethylene terephthalate ("PET") bottles. The cap comprises a threadable round body, an engageable cover protecting the hollow cylindrical central stem containing the additive and covered in its lower end with a metallic film that prevents the exit of the additive. By removing the cover and pressing the stem downwards the film is broken by the lower internal knives forming part of the cylindrical guide of the stem.

U.S. Pat. No. 4,903,865, published Feb. 27, 1990, inventor C. Michael Janowitz, describes a cap releasing an additive exerting pressure downwards. The cap comprises a threadable round skirt and a stem like central compartment with a metallic film in the lower border to define an additive containing compartment. By applying pressure downwards on the stem, the additive is released within the container for mixing with the contents thereof.

U.S. Pat. No. 4,722,449, published on Feb. 2, 1988, inventor Dubach Werner F., describes a two part closure or cap provided with an additive top compartment and a lower beak tearing the film or seal on the beak of the container. The cap contains the additive and by twisting thereof presses the beak to break it and release the contents in the container to effect the mixture with its contents.

SUMMARY OF THE INVENTION

It is an object to the present invention to provide a dosing cap designed to store inside a product that may be a flavoring, a vitamin, an energy supplement, or medicinal tonics, etc. The product may be in the form of powders, pellets or liquids for release by opening the cap or closure.

It is another object of the present invention to provide a dosing cap that keeps the concentrated product or flavoring separate from the liquid contained in the bottle, prolonging the shelf life thereof, and allowing the user to make the mixture at the moment it is to be consumed.

It is also an object of the present invention to provide a dosing cap constructed in a single plastic piece, a cap with a cylindrical skirt provided with a central stem and a cylinder container with a concentrate, provided with tearing ends in the lower edge and a no tearing zone.

It is still another object of the present invention to provide a metallic film seal, hermetically closing the cylindrical lower edge of the cap. Together they form the seal where the product to be preserved is stored. The product is released by pressing the top part of the cap on the center thereof, to drive a central stem that pushes the seal, designed using the elastic properties of plastic. The spring or bellows means prevents the seal from returning, keeping it open and allowing the passage of the product towards the liquid to efficiently carry out the mixing.

It is still another object of the present invention to provide a cap that hermetically stores a concentrated product. The release of the concentrated product is made by pressing with a finger at the center of the top part of the cap. This part at the center of the cover remains downwards, with this opening the seal that retained the product and allowing passage thereof towards the liquid. Then the consumer shakes the package until obtaining the mixture between the product and the liquid. The cap is then opened as normally made with standard caps and the mixture made is consumed.

It is another object of the present invention to provide a cap that keeps the concentrate product or flavoring separated from the liquid contained in the bottle until the moment it is to be consumed. It is useful for products having a short shelf life, once they are mixed to each other, to use a liquid additive concentrate product.

DETAILED DESCRIPTION OF THE INVENTION

Figure 1:
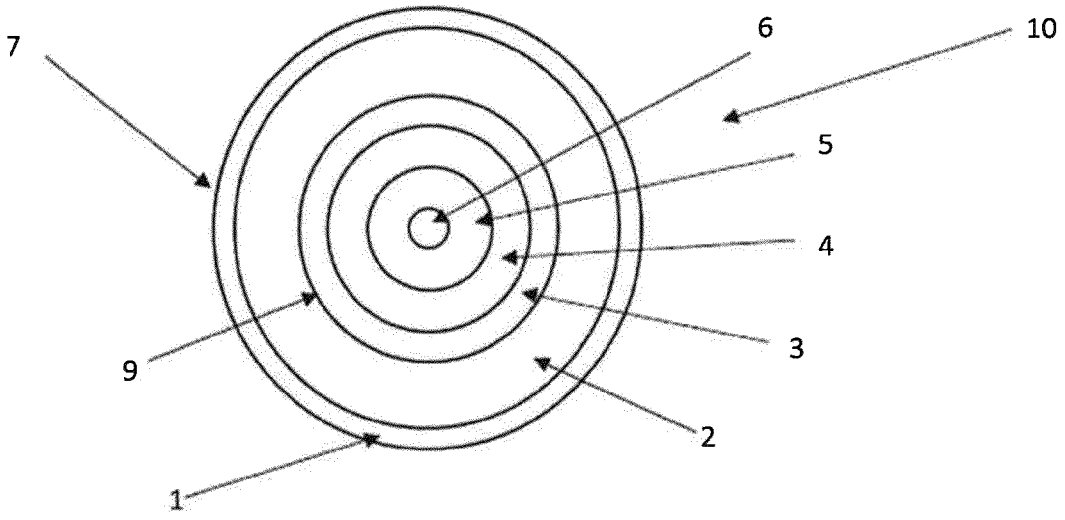
FIG. 1, is a top view of the cap of the present invention where it is shown the top skirt ring and the flexible center.

There is the condition that some prepared beverages have a short shelf life, thus requiring special storage or refrigeration conditions, or even the restriction of a short period for consumption. If not consumed in a short time frame, these prepared beverages lose their properties, and with this, the beverages have a reduced presence in the marketplace. These beverages can be a flavoring, a vitamin, an energy supplement, a nutritional supplement, a medicinal product or other products with a short shelf life.

Sometimes to extend the shelf life, it is necessary to use additives, preservatives or other substances mixed with the product. This addition increases the cost of the product and the product's properties are modified. In other cases, the bottles, in which the product is packaged, are modified, by means of the use of Ultra-violet ("UV") ray protective agents, pigments or other additives that help prolong the shelf life of the contents. The above modifications increase production costs (in the distribution), change the properties of the beverage and, in most of the cases, the required shelf life is not reached. This results in a negative impact in the market.

The single piece dosing cap for the release of concentrate of the present invention is designed to prolong the shelf life of the product, while maintaining separate the concentrate flavoring product, or another product, from the liquid until the moment of consumption. This way the required shelf life of the product is reached and the properties of the product with the special diffused characteristics for the beverage are kept.

The single piece dosing cap for the release of concentrate is designed with an external section and an internal section with a structure to maintain the concentrate product or additive separate from the liquid used as mixing agent contained in a bottle or package. This bottle can be made of plastic or glass, or another material, thereby allowing the bottle to maintain the properties of the product for a long shelf period. The cap allows for mixing of the concentrate product with the liquid at the moment of consumption, thus reducing or eliminating the use of additives, preservatives, or other substances in the product and avoiding use of UV-rays protectants in bottles, or even pigments that increase the cost of the product not extending the shelf life per periods so prolonged. This is accomplished with the use of the single piece dosing cap for the concentrate release enabling prolonged periods of shelf life to be reached and the original properties of the product to be kept.

The cap is made by a plastic injection process in a single mold, using a resin, such as polyethylene, polypropylene, or other plastic resins commonly used to make these parts.

This cap having as a main characteristic, the ability to hermetically store the concentrate substance. The cap also has the ability to enable the release to be carried out by a finger pressing the top part of the cap until the spring effect or top folds creased at the center thereof forming a diaphragm with concentric rings located in different planes. This provides the recovery of the plastic with bellows type folds. The top central part of the cap is kept in a downwards extended position, driving the seal tearing cylinder to allow its opening and exit of the contents from the cap seal and allowing its passage towards the liquid. The consumer then shakes the container to make the mix between the additive and the liquid of the beverage. The cap is then opened as normally done with standard caps and the mix is consumed. The tearing device comprises a flexible diaphragm consisting of three concentric continuous rings located in different planes, a hollow cylinder with tearing teeth in the lower perimeter edge, a central stem, the hollow cylinder acting as support structure of the tearing teeth located in the lower edge. The diaphragm is pressed to depress it, the cylinder teeth are driven downwards to reach the seal or membrane and tear it, supported with the drive of the stem to tear and separate such membrane to allow the flow of additive inside the container to mix with the substance contained in the bottle or container. The flexible diaphragm comprises circular concentric lines allowing flexibility thereto and defining flat zones or diaphragm rings having underneath a stem and a tearing cylinder.

FIG. 1, is a top view (10) of the external section of the single piece round dosing cap for threaded neck containers. The cap comprises a side round skirt (7) providing structure to a top flat ring (2) limited by an external perimeter edge (1) and an internal vertical wall defining a container cylinder (9) extending beyond the lower edge of a security band, such wall limits an internal depression wherein a horizontal diaphragm is located defined by thin lines limiting flat rings in different planes to make a flexible sectional diaphragm with spring or recovery properties. The diaphragm comprises a first external ring (3), a second middle ring (4) and a central flat ring (5) limited by circumferences. The central ring has a base (6) for a vertical central stem. The lower diaphragm face supports a structure formed by a central stem. A cut or tear cylinder in the lower edge is provided with tearing or cutting spikes (not shown). The diaphragm, with circular lines and bellows or accordion type discs, is flexible and when pressure is exerted to depress it, the hollow cylinder tearing teeth are driven downwards to reach the film, metallic seal sheet. Then the seal sheet is cut at locations regularly placed at each quarter-turn, i.e. at about 90° ($\pi/2$) to allow free flow of additive or flavoring mixed with the contents of the container, recipient or bottle.

Figure 2:
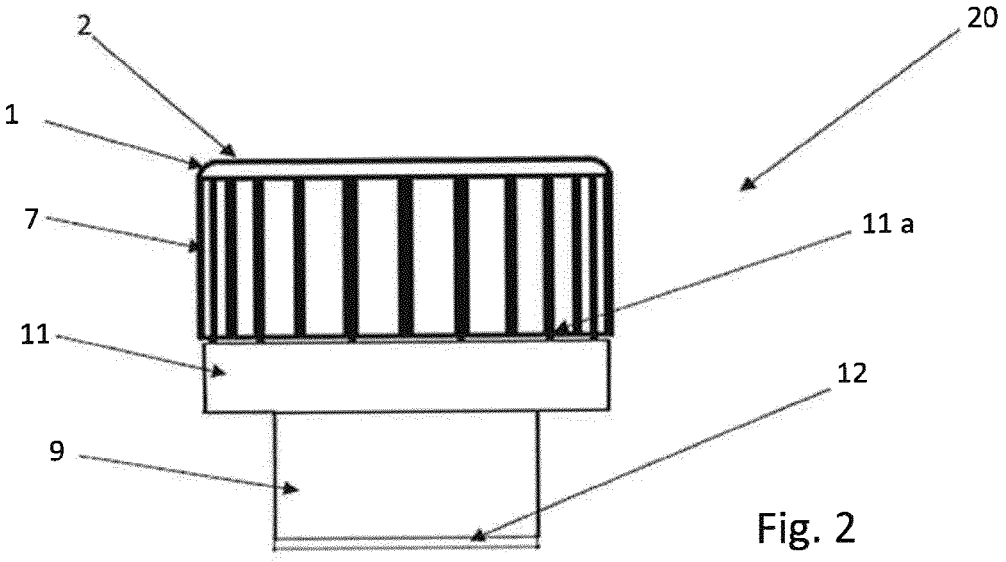
FIG. 2, is a side view of the cap of the present invention where the skirt and internal cylinder are shown.

FIG. 2, is an external side view (2) of the dosing cap of the present invention. There is shown the perimeter flat ring (2) of the top face of the cap, and the perimeter edge (1) that separates the vertical side skirt (7) of the perimeter ring (2). Within the skirt is contained a diaphragm structure, a container cylinder (9) and a cutting cylinder (not shown). The side round skirt (7) is located joined to a security or anti-tampering band (11) by means of the membranes (11*a*) torn by the opening turning action of the cap or closure of the present invention. The lower edge of the container cylinder (9) holds a metallic or aluminum film seal (12) keeping an additive within the container cylinder (9) located from the inside of the upper ring (2) of the cap and further beyond the lower edge of the security band (11). To release such content, it is necessary to tear the seal (12) or film which is adhered to the lower perimeter of the container cylinder (9) extending from the vertical inside wall of the cap.

Figure 3:
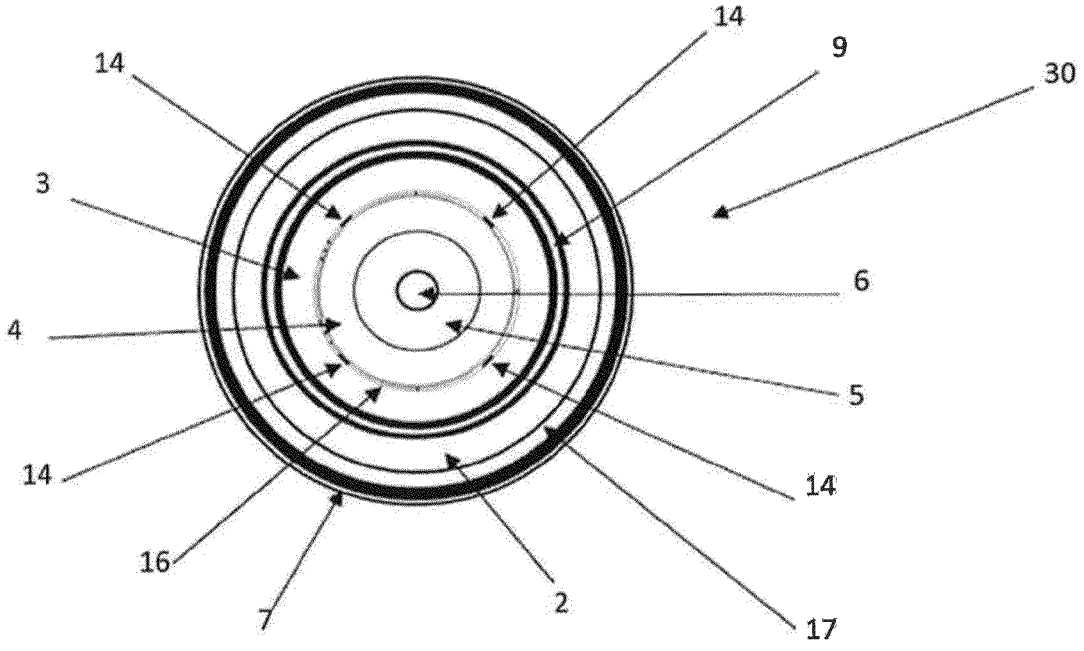
FIG. 3, is a bottom view where the different component rings of the dosing cap of the present invention are shown.
Figure 4:
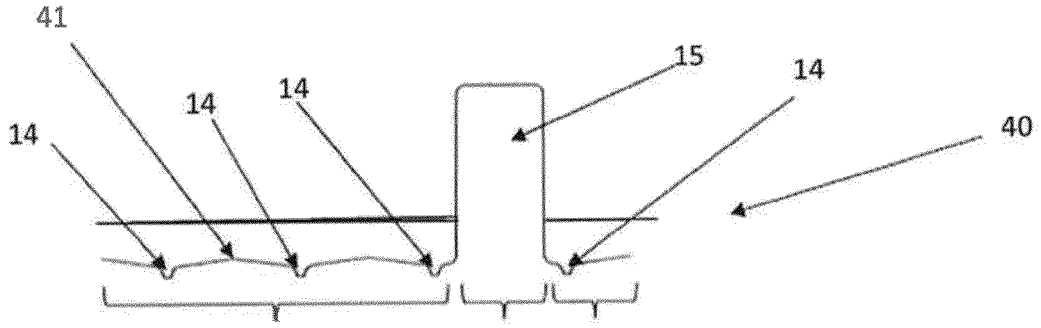
FIG. 4, is an unfolded side view of the inside cut edge of the tear internal cylinder, highlighting the non-cut, cutting edge free zone.

FIG. 3, shows a lower view (30) of the internal section of the single piece dispensing lid of the present invention. In this view are shown a series of concentric circumferences and circles. At the center of the lid is the stem base (6) surrounded by the central flat ring (5). The central flat ring (5) is followed by a fold circumference, the second middle ring (4), this is followed by a cylindrical wall of the cutting cylinder (16) together with the second fold circumference, the cutting cylinder having a series of four rupture tips or cutting edges (14) located regularly at 90° along the circumference. The rupture tips are responsible for tearing the seal located in the perimeter edge of the container cylinder (9). Between the cutting cylinder (16) and the container cylinder (9) is located another diaphragm ring (3) or first flexible ring joined to the internal wall of the container cylinder (9). Within the area defined by the container cylinder is defined a depression and the flexible diaphragm that allows the cutting cylinders (16) and the stem to descend up to the metallic film seal keeping inside the cylinder the additive to be poured. Outside the container cylinder (9) is defined a step made by a perimeter flat ring (2) and the side vertical skirt wall (7) that in addition in the internal wall has a plurality of thread ribs (17) with a triangular shaped cross-section to lock them in the thread of the bottle's beak. The container cylinder (9) acts as a closure seal with the inner part of the beak of the container FIG. 4, is an exploded view (40), of the cutting edge section, showing in turn the cutting and non-cutting sections, the non-cutting section corresponds to a lower radius and to a quarter-turn, i.e. a section occupying about a 90° arch, located between two tapering spikes, having between them a separation of about 90° totally a set of four spikes along the perimeter of the lower border of the cutting cylinder. The non-cutting section (15) allows the seal film to be adhered to the container cylinder (9). This ensures the seal pieces are not mixed with the contents of the container or bottle. The seal pieces merely remain hanging and allow complete exit of the additive in the container cylinder. The spikes (14) are separated by about a quarter turn or a 90° arch (nD/4) (41) in which "D" is the cutting cylinder diameter having four edges regularly spaced to break the film seal adhered to the container cylinder edge.

Figure 5:
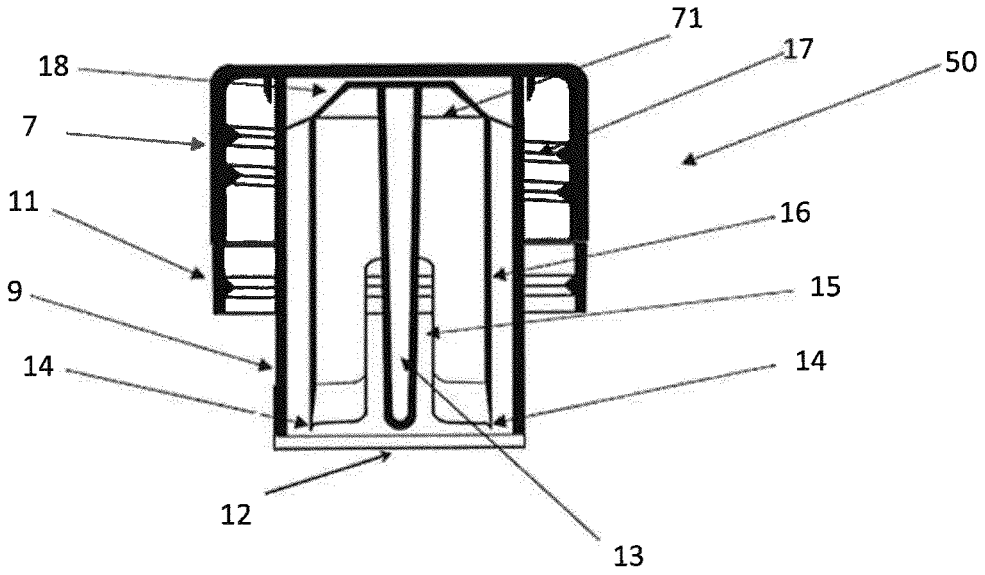
FIG. 5, is a side cut view of the dosing cap structure of the present invention where are shown the central stem, the bellows or accordion type flexible center, the cylinder container, the cut or tear edges, and the lower seal metallic film.

FIG. 5 is a side cut view (50) of the dispensing lid of the present invention. The seal (12) is not an integral part of the cap. The seal (12) is adhered to the lower edge of the container cylinder (9) and the flexible diaphragm (18) is in its highest position holding a central stem (13) with a length comparable to the container cylinder and a tearing cylinder (16). Displayed is another view of the non-cutting sector window (15) in addition to the tearing spikes (14) in the lower edge of the tearing cylinder (16). Following is a description of the seal cutting action in which the diaphragm (18) is depressed with the finger to lower the central stem structure and the cutting cylinder with which the seal is torn and further pushed with the lower end of the stem to allow complete breaking. The additive and the diaphragm device and breaking are located within a cylinder having a larger diameter named container or housing cylinder which top edge defines a central depression occupied by the diaphragm (18) and the vertical internal wall edge (71). The internal structure is surrounded or protected by a side cylindrical skirt (7) that together with a top perimeter flat ring and security band makes a shell surrounding the tearing mechanism and the thread ribs (17) located in the internal face of the skirt (7) in a tilted direction. This ensures that the container cylinder (9) is housed within the neck of the container, with the ribs and the cap is located in the beak of the bottle to provide a tight seal thereto. The flexible diaphragm (18) holds the stem and the tearing cylinder.

Figure 6:
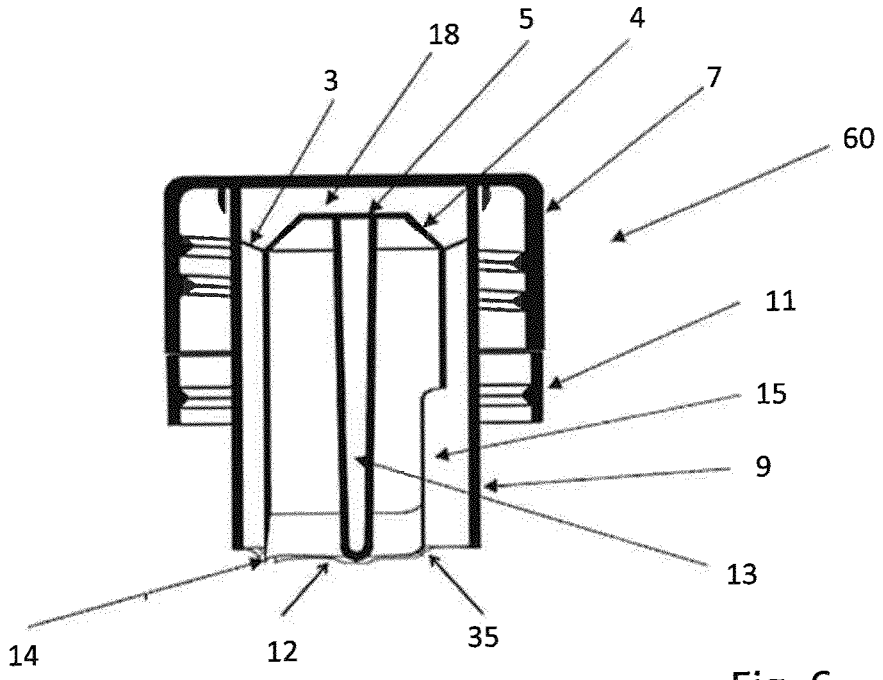
FIG. 6, is a side cut view of the cap and the seal of the present invention wherein is shown the seal cut position, in which the stem helps driving the film outside its seal position.

FIG. 6, is a side cut view (60) at the exact moment of a partial tear of the seal (12) when the first ring (3) of the flexible diaphragm (18) is depressed. FIG. 6 shows vertical movement downwards from the cutting cylinder where the spikes (14) make a partial seal tear and remain adhered (35) in the non-cutting sector (15) at the edge of the container cylinder (9). The second middle ring (4) is not depressed and the stem (13) makes contact with the seal without still pushing yet. With pushing downwards of the diaphragm the central flat and second middle rings (5), (4) make the central stem press on the seal completing the tearing to allow pouring the additive in the contents of the container. All that within the shell is defined by the skirt (7) and the security band (11).

Figure 7:
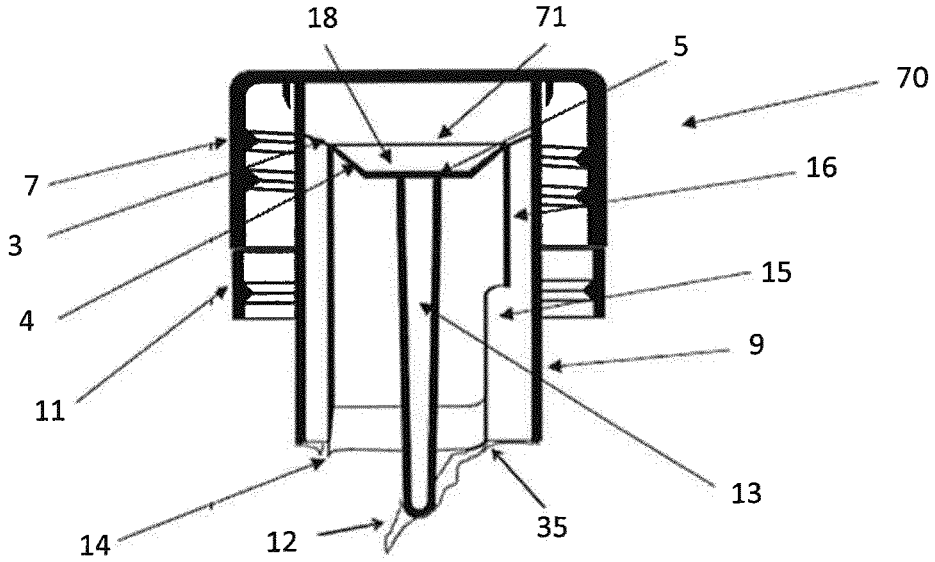
FIG. 7, is a side cut view of the cap and the seal in opening position in which the flexible center is depressed and the seal is torn with a section still stuck on the border of the cylinder to prevent mixing with the contents of the container.

FIG. 7, is a side cut view (70) in the exact moment of a partial tear of the seal (12) when the first ring (3) of the flexible diaphragm (18) is totally depressed, showing vertical movement downwards from the cutting cylinder (16) where the spikes (14) have torn the seal and a section thereof remains adhered (35) in the non-cutting sector (15) at the edge of the container cylinder (9). The second ring (4) has pushed the seal to ensure its tearing the central ring (5) is now located at a level lower than the edge of the vertical inside wall (71). With the push downwards of the diaphragm, the central flat and second middle rings (5), (4) are depressed all along making the central stem apply pressure on the seal completing the tearing to allow pouring the additive in the contents of the container. All this within the shell is defined by the skirt (7) and the security band (11) to make together the external section of the dispensing lid.

Figure 8:
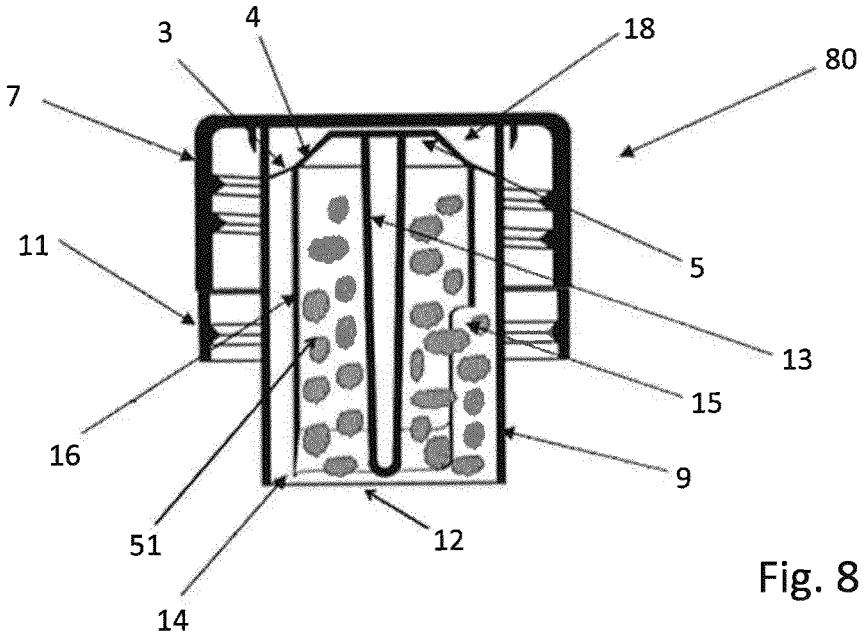
FIG. 8, is a side cut view of the cap and seal in closing position with the cylinder container filled with pellets of additive and the seal unbroken.

FIG. 8, is a side cut view (80) of the dispensing lid of the present invention in which the container cylinder (9) is full of powder or pellets additive (51) confined within the container cylinder (9) and the metallic film or seal (12), which can a be an aluminum sheet with plastic coating to adhere in one of its faces at the lower edge of the container cylinder (9) by the induction process, while the diaphragm (18) remains in the raised state with the rings (3, 4 and 5) not depressed and keeping the central stem (13) and the cutting cylinder (16) separate from the seal without the tearing spikes (14) tearing such seal. This stable situation, with the contents not poured, is kept within the side skirt (7) and the security band (11) also joining the skirt making a single piece at molding.

Figure 9:
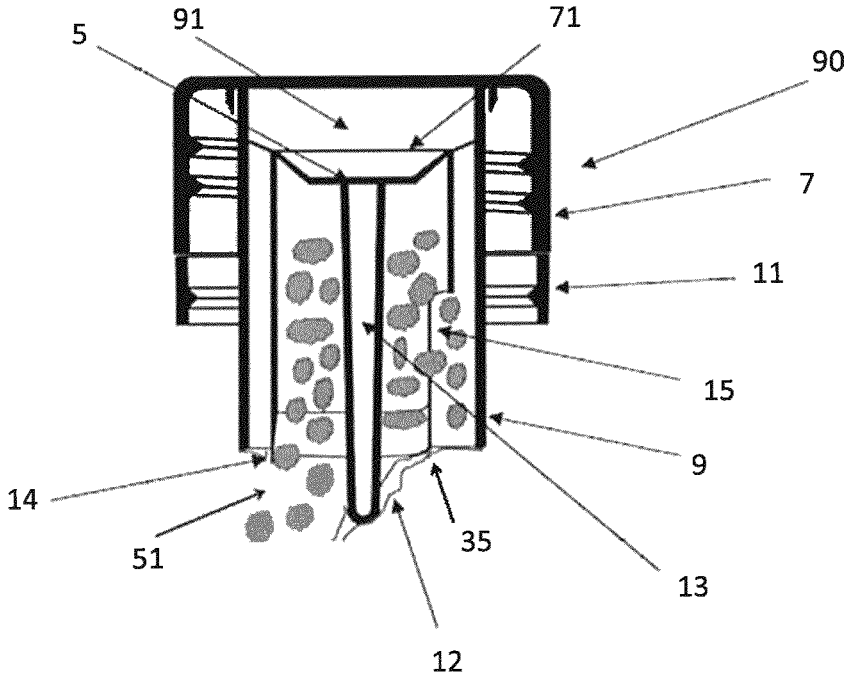
FIG. 9, is a side cut view of the cap and the seal turned allowing downward flow and inside the additive container, the central flexible section of the cover cap is fully depressed.

FIG. 9, is a side cut view (90) showing the push action on the diaphragm making the depression of the component rings thereof to tear the seal or aluminum film to allow free flow of the additive inside the container or package. In this case, the additive is in powder form finding a free exit to the recipient contents and the seal remains at the edge of the of the container cylinder (9). In fact, within the seal band (11) and the side skirt (7), the diaphragm has been depressed with the central flat ring (5) in its lowest position with respect to the edge (71) of the internal vertical wall (91) In this position of the diaphragm, the stem has pushed the seal (12) after being torn by the tearing spikes (14), the pieces of the seal are kept joined to a sector (35) of the non-tearing section (15) in the lower edge of the container cylinder (9) to avoid pieces of the seal in the additive being mixed with the contents of the bottle or container using the tight seal of the present invention.

Figure 10:
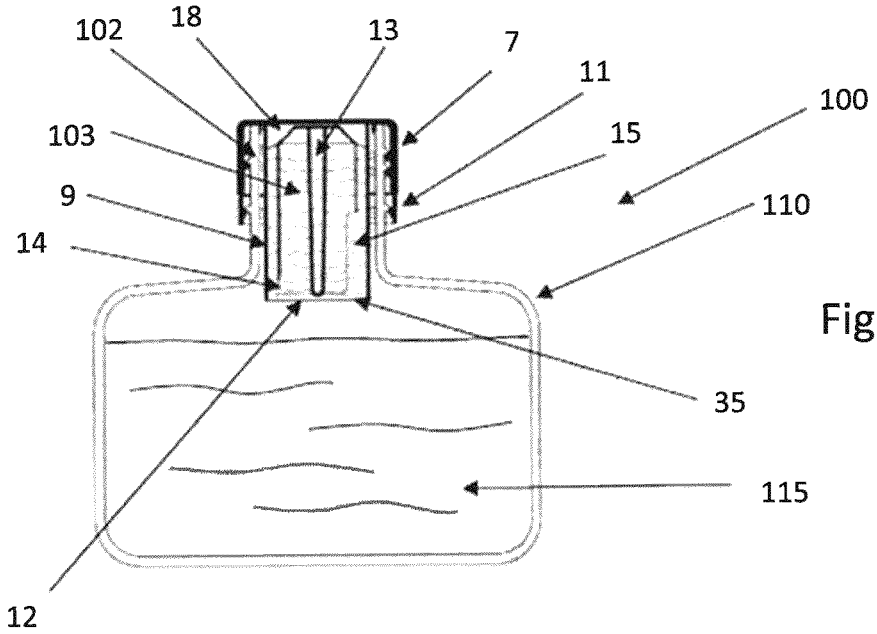
FIG. 10, is a side cut view showing a fluid filled container and cap in closure position thereof, with the compartment full liquid additive.

FIG. 10, is a side cut view (100) of a bottle (110) using the dispensing lid of the present invention, containing a liquid additive (103) to pour in water or liquid (115). The cap is coupled to the beak (102) of the bottle through the skirt (7) and the security band (11). In this case, the bottle is kept in this stage shown while in transit to the market, i.e. before the consumer buys it to pour the additive in the contents of the bottle. The flavoring or additive (103) is isolated from the liquid of the bottle by means of a film or seal (12) and the container cylinder (9) is in an unalterable situation while no pressure is made with the finger on the diaphragm (18) to press and push the stem (13) and the cutting spikes (14) on the seal surface to tear it and allow the exit of the additive. The seal is kept adhered in the sector (35) to avoid polluting the mix with fractions thereof.

The invention claimed is:

1. A one piece dispensing lid comprising:

an external section and an internal section, the internal section having a plurality of thread ribs, the external section having a top edge with a central depression housing a flexible diaphragm, the central depression surrounded by a perimeter flat ring having a rounded edge that is attached to a vertical side skirt;

within the vertical side skirt is a hollow cylinder structure and a central stem, the vertical side skirt is joined to a security band by a membrane;

a container cylinder extending from the inside of the top edge of the external section to a lower edge of the security band, the container cylinder containing an additive;

the flexible diaphragm defining a tearing device is made up of three concentric continuous rings located in different planes, the three concentric continuous rings allowing for flexibility of the flexible diaphragm and defining flat zones or diaphragm rings, whereby underneath the flexible diaphragm is the hollow cylinder structure and the central stem, the hollow cylinder having tearing teeth in a lower perimeter edge; and a length of the hollow cylinder structure is approximately equal to the length of the container cylinder; and a metallic sheet seal tightly closing the lower edge of the container cylinder and not being an integral part of the lid.

2. The one piece dispensing lid according to claim 1, wherein the flexible diaphragm comprises three concentric rings in different planes, an external ring joined to an inside wall of the container cylinder to support a second ring and a third central ring, wherein the central stem is located at a juncture between the first ring and the second ring.

3. The one piece dispensing lid according to claim 2, further comprising at a lower edge of the tearing device, four tearing spikes uniformly distributed 90° from one another; and by pressing of the flexible diaphragm, the four tearing spikes tear the metallic sheet seal and the central stem pushes it.

4. The one piece dispensing lid according to claim 2, wherein the tearing device comprises a non-cutting section corresponding to an arch of about a quarter of turn or 90°, to allow the seal in non-cutting section to remain joined to a lower edge of the container cylinder.

5. The one piece dispensing lid according to claim 1, wherein an inside of the round side skirt is located in a beak thread of a bottle or a container and the container cylinder is located within a neck of the bottle or container, to ensure pouring of the additive into contents of the container.

6. The one piece dispensing lid according to claim 1, wherein a space formed by the container cylinder and the metallic sheet seal is filled with the additive.

7. The one piece dispensing lid according to claim 1, whereby to release the additive downwards, the flexible diaphragm is pressed and the central stem pushes the metallic sheet seal and the tearing spikes to break the metallic sheet seal while remaining attached to an edge of the container cylinder.

8. The one piece dispensing lid according to claim 1, wherein a space, defined by the container cylinder and the metallic sheet seal, contains the additive in powder, pellets or liquid form.

* * * * *